US005230636A

United States Patent [19]

Masuda et al.

[11] Patent Number: 5,230,636

[45] Date of Patent: Jul. 27, 1993

[54] TERMINAL PROTECTION TYPE CONNECTOR

[75] Inventors: Toshihiko Masuda; Hiroshi Yamamoto; Hitoshi Sakai, all of Shizuoka, Japan

[73] Assignee: Yazaki Corporation, Tokyo, Japan

[21] Appl. No.: 980,337

[22] Filed: Nov. 23, 1992

[30] Foreign Application Priority Data

Nov. 29, 1991 [JP] Japan ..... 3-98743[U]

[51] Int. Cl.[5] ..... H01R 13/627

[52] U.S. Cl. ..... 439/358; 439/140; 439/354

[58] Field of Search ..... 439/350-358, 439/488, 489, 135, 136, 137, 140, 141, 147, 595, 599

[56] References Cited

U.S. PATENT DOCUMENTS

| | | | |
|---|---|---|---|
| 4,557,542 | 12/1985 | Coller et al. | 439/595 |
| 4,657,331 | 4/1987 | Coldren | 439/357 |
| 4,969,831 | 11/1990 | Kazuno et al. | 439/266 |
| 5,037,319 | 8/1991 | Hatagishi | 439/137 |

*Primary Examiner*—Larry I. Schwartz
*Assistant Examiner*—Hien D. Vu
*Attorney, Agent, or Firm*—Sughrue, Mion, Zinn, Macpeak & Seas

[57] ABSTRACT

In a terminal protection type connector in which a flexible locking arm for locking a female connector housing is provided on a male connector housing, and the elastic contacts of terminals accommodated in the male connector housing are exposed through openings formed in the latter, a terminal protecting member is slidably mounted on the male connector housing in such a manner that said terminal protecting member covers the openings and engages with the flexible locking arm.

8 Claims, 4 Drawing Sheets

TERMINAL PROTECTION TYPE CONNECTOR

BACKGROUND OF THE INVENTION

This invention relates to a terminal protection type connector in which the elastic contact parts of the terminals thereof are protected which are exposed outside the connector housing.

FIG. 7 shows a conventional terminal protection type connector disclosed by Japanese Utility Patent Application (OPI) No. 146982/1988 (the term "OPI" as used herein means an "unexamined published application"). As shown in FIG. 7, the conventional terminal protection type connector 35 is provided with a distribution box 36 having a mating female connector 37.

The terminal protection type connector 35 comprises: a male connector housing 38 having openings 41; and terminals 39 built in the male connector housing 38, the terminals 39 having elastic contacts 40 which are set in the openings 41 of the housing 38; and a slide cover 43 slidably engaged with two guides 42 on both sides of the housing 38 so as to close and open the openings 41.

The female connector 37 is provided with terminals 45 of a flexible printed circuit 44 which is bonded to a distribution box. The elastic contacts 40 are exposed by opening the cover 43 of the terminal protection type connector 35, so as to be connected to the terminals 45 of the printed circuit 44.

The terminal protection type connector 35 thus designed is disadvantageous in the following points: That is, since the male connector housing 38 has the guides 42 for the slide cover 43 as was described above, the connector 35 is relatively large in thickness, and accordingly the female connector 37 is also large in volume. In addition, opening the cover 43 for every connection of the connector is rather troublesome.

SUMMARY OF THE INVENTION

Accordingly, an object of this invention is to eliminate the above-described difficulties accompanying a conventional terminal protection type connector.

More specifically, an object of the invention is to provide a terminal protection type connector with which it is unnecessary to increase the volume of the mating female connector, and which is free from the difficulty that it is necessary to manually open the cover for every connection of the connector.

The foregoing object and other objects of the invention have been achieved by the provision of a terminal protection type connector in which a flexible locking arm for locking a male connector housing to a female connector housing is provided on the male connector housing, and the elastic contacts of terminals accommodated in the male connector housing are exposed through openings formed in the male connector housing; which comprises: a terminal protecting member mounted on the outer wall of the male connector housing in such a manner that the terminal protecting member covers the openings and engages with the flexible locking arm.

As the male connector housing is inserted into the female connector housing, the flexible locking arm is bent inwardly, so that it is disengaged from the terminal protecting member while being slid backwardly.

The nature, principle, and utility of the invention will be more clearly understood from the following detailed description of the invention when read in conjunction with the accompanying drawings.

DETAILED DESCRIPTION OF THE INVENTION

Preferred embodiments of this invention will be described with reference to the accompanying drawings.

Figure 1:
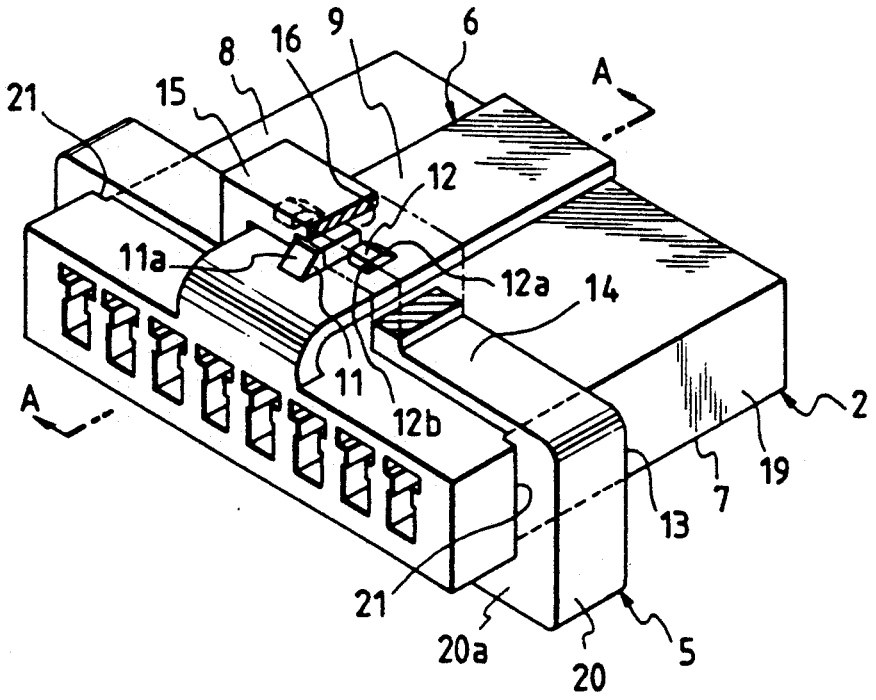
FIG. 1 is a perspective view, with parts cut away, showing one example of a terminal protection type connector according to this invention.
Figure 2:
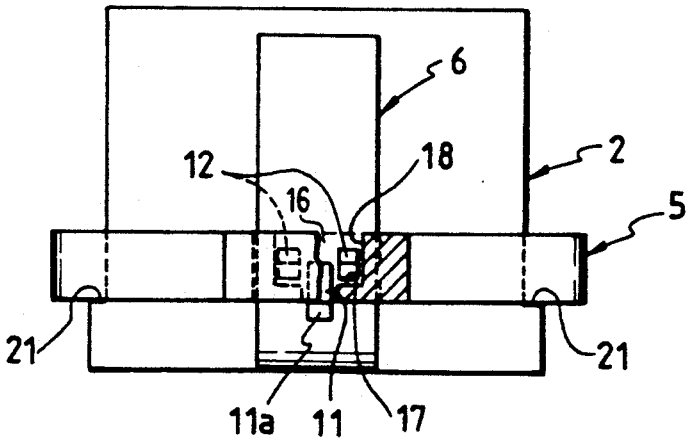
FIG. 2 is a plan view of the terminal protection type connector shown in FIG. 1.
Figure 3:
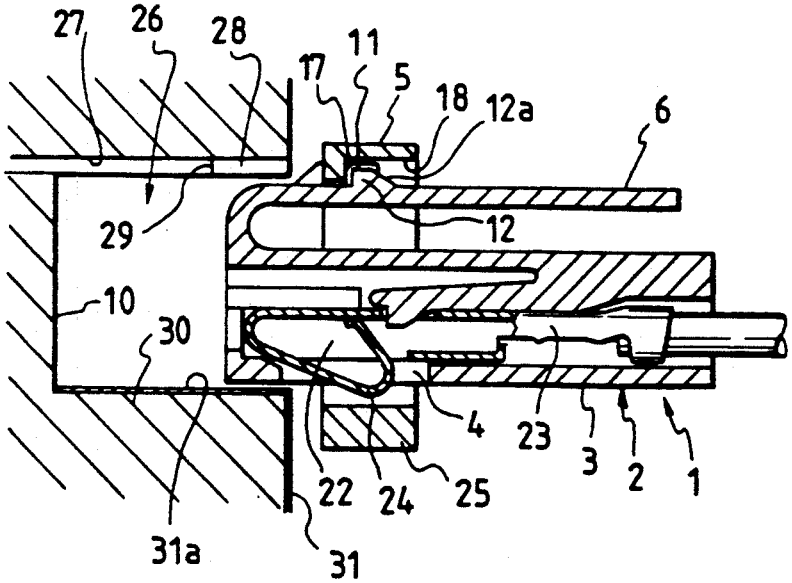
FIG. 3 is a sectional view showing the terminal protection type connector taken along line A—A in FIG. 1 in a state where the connector is to be connected to a printed cirsuit.

An example of a terminal protection type connector, which constitutes a first embodiment of the invention, is a male connector as shown in FIGS. 1 through 3. A specific feature of the terminal protection type connector resides in that a terminal protecting member 5 covering openings 4 (FIG. 3) which are formed in the bottom 3 of a male connector housing 2 of synthetic resin to expose terminals, is slid along the outer wall 7 of the male connector housing 2 while engaging with a flexible locking arm 6.

The flexible locking arm 6 is formed on the male connector housing 8 in such a manner that it is extended in a front-to-rear direction over the upper wall of the male connector housing 8. A locking projection 11 for engaging a mating female connector 10 (FIG. 3), and a pair of locking protrusions 12 for engaging the terminal protecting member 5 are formed on the upper surface of the flexible locking arm 6 in such a manner that the locking protrusions 12 are slightly behind the locking projection 11. The locking projection 11 has a forwardly inclined guide surface 11*a*. Each of the locking protrusions 12 has a backwardly inclined guide surface 12*a* and an upstanding abutment surface 12*b*.

The terminal protecting member 5 is made of synthetic resin. More specifically, the terminal protecting member 5 comprises an annular part 13 substantially rectangular in section which has an insertion gate 15 on its upper wall 14 at the middle into which the locking arm 6 is inserted. The insertion gate 15 has an insertion groove 16 in the inner surface which is provided for receiving the locking projection 11 of the locking arm 6, and engaging grooves 18 which have front step-shaped stoppers 17 against which the locking protrusions 12 initially abut.

A pair of engaging steps 21 are formed on both side walls 19 of the male connector housing 2, so as to engage with the front end faces 20*a* of both side walls 20 of the terminal protecting member 5. When the terminal protecting member 5 is mounted on the male connector housing, the forwardly inclined guide surface 11*a* of the locking projection 11 is protruded from the terminal protecting member 5 as shown in FIG. 2.

As shown in FIG. 3, the bottom 3 of the male connector housing 2 has the aforementioned openings 4 which are communicated with a terminal accommodating chamber 22. The elastic contacts of terminals 23 are exposed through the openings 4. The bottom wall 25 of the terminal protecting member 5 is confronted with the elastic contacts 24, to protect the elastic contacts 24 from external interference.

An engaging protrusion 28, and an engaging step 29 merging with the former 28 are formed on the upper inner surface 27 of the female connector housing 10 along the opening, so as to be engaged with the locking projection 11 of the male connector housing 2. Terminals 31*a* of a printed circuit 31 are provided on the lower inner surface 30 of the female connector housing 10, so as to be connected to the elastic contacts 24 of the male connector 1.

Figure 4:
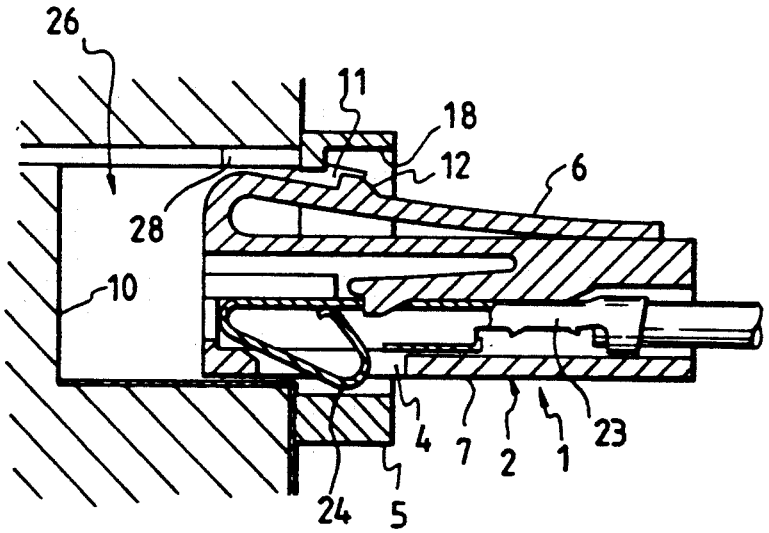
FIG. 4 is a sectional view showing the terminal protection type connector which is being connected to a mating female connector.
Figure 5:
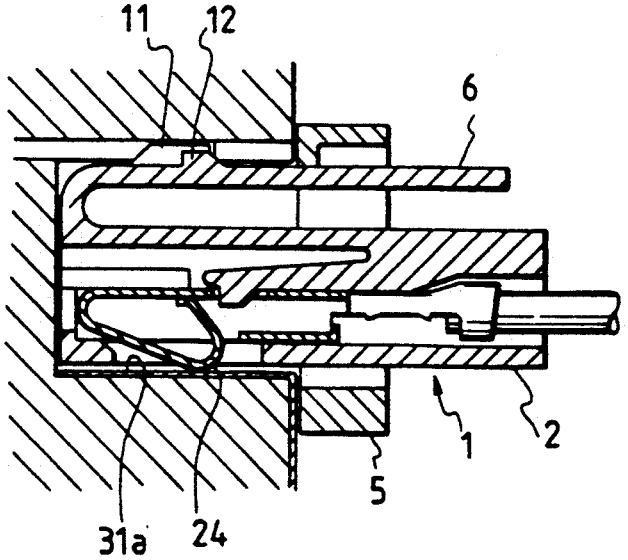
FIG. 5 is a sectional view showing the terminal protection type connector which has been connected to the mating female connector.

FIGS. 4 and 5 show how to engage the male connector 1 with the female connector 26.

As shown in FIG. 4, the forwardly inclined guide surface 11*a* of the locking projection 11 is engaged with the engaging protrusion 28 of the female connector 10, so that the locking arm 6 of the male connector housing 2 is bent downwardly. As a result, the locking protrusions 12 of the locking arm 6 is moved away from the engaging grooves 18 of the terminal protecting member 5, and therefore the terminal protecting member is disengaged from the locking arm. Thus, as the male connector 1 is inserted into the female connector, the terminal protecting member 5 is automatically slid backwardly, and upon completion of the insertion, as shown in FIG. 5 the terminal protecting member 5 is held by the elastic force of the locking arm 6.

Figure 6:
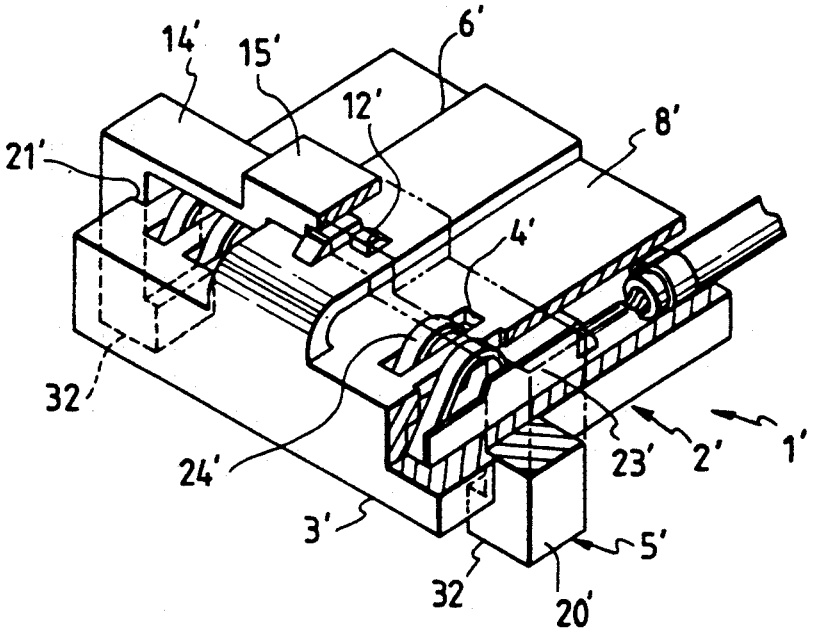
FIG. 6 is a perspective view, with parts cut away, showing another example of the terminal protection type according to the invention.
Figure 7:
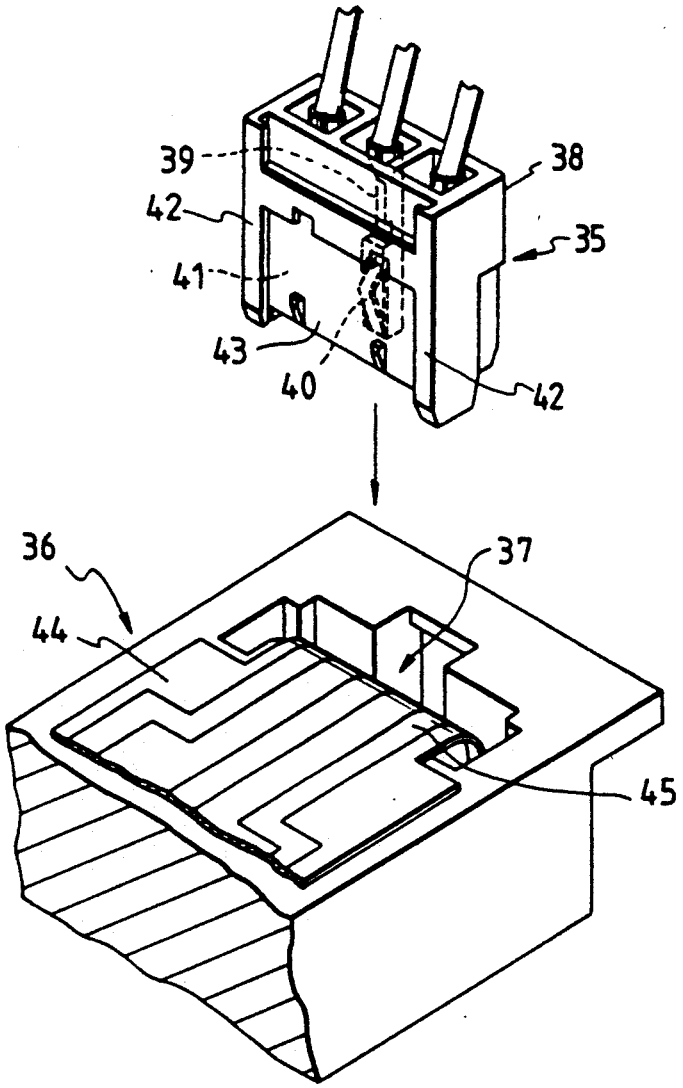
FIG. 7 PRIOR ART
FIG. 7 is a perspective view showing a conventional terminal protection type connector.

FIG. 6 shows another example of the terminal protection type connector according to the invention, which constitutes a second embodiment of the invention. A specific feature of the terminal protection type connector of the terminal protection type connector 1' resides in that openings 4' for exposing the elastic contacts 24' of terminals 23' are formed in the upper wall 8' of a male connector housing 2 on which a flexible locking arm 6' is provided, and a terminal protecting member 5' substantially U-shaped in section are mounted on the male connector housing 2' so as to cover the openings 4'.

The terminal protecting member 5' has: an insertion gate 15' on its upper wall 14' which is similar to the insertion gate 15 of the first embodiment, so as to be engaged with the locking arm 6'; and sliding protruded walls 32 formed on both side walls 20' so as to be engaged with the bottom wall 3' of the connector housing. Its connector housing locking structures 12' and 21' are similar to those in the first embodiment.

As was described above, in the terminal protection type connector of the invention, the terminal protecting member is mounted on the male connector housing in such a manner that it is slidable along the outer wall of the latter. Therefore, the dimension of the mating female connector is not affected by the terminal protecting member, and depends only on the size of the male connector housing. That is, it is unnecessary to increase the volume of the female connector. On the other hand, as the male connector is inserted into the female connector, the terminal protecting member is automatically slid, and disengaged from the flexible locking arm. Therefore, the connection of the connection can be achieved with ease. Since the terminal protecting member is locked with the existing flexible locking arm on the connector housing, it is unnecessary to substantially modify the connector. That is, the terminal protection type connector can be formed at relatively low manufacturing cost.

While there has been described in connection with the preferred embodiments of this invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A terminal protection type connector, comprising:

a male connector housing adapted to be mated with a female connector housing;

a flexible locking arm provided on said male connector housing for locking said male connector housing to said female connector housing;

at least one terminal accommodated in said male connector housing, said terminal having an electric contact exposed outside said male housing through an opening formed in said male connector housing; and a terminal protecting member mounted and retained onto said male connector housing by said flexible locking arm for covering said electric contact at said opening.

2. The connector according to claim 1, wherein the retainment of said terminal protecting member onto said male connector housing is released by displacing said flexible locking arm relative to said male connector housing.

3. The connector according to claim 1, wherein said terminal protecting member is movable along said flexible locking arm in conjunction with insertion of said male connector housing into said female connector housing.

4. A terminal protection type connector, comprising:

a male connector housing adapted to be mated with a female connector housing;

a flexible locking arm provided on said male connector housing for locking said male connector housing to said female connector housing;

at least one terminal accommodated in said male connector housing, said terminal having an electric contact exposed outside said male housing through an opening formed in said male connector housing; and a terminal protecting member adapted to be mounted onto said male connector housing; and first means provided on said flexible locking arm for retaining said terminal protecting member at a predetermined position on said male connector housing for covering said electric contact at said opening.

5. The connector according to claim 4, wherein said first means includes at least one projection formed on said flexible locking arm.

6. The connector according to claim 4, further comprising:

second means for releasing the retainment by said first means in conjunction with insertion of said male connector housing into said female connector housing.

7. The connector housing according to claim 6, wherein said second means includes a protrusion formed on said female connector housing for displacing said flexible locking arm in conjunction with the insertion of said male connector housing into said female connector housing.

8. The connector according to claim 6, further comprising:

third means for moving said terminal protecting member from said predetermined position along said flexible locking arm in conjunction with the insertion of said male connector housing into said female connector housing when the retainment by said first means is released by said second means, for electrical connection between said electric contact and a mating contact provided on said female connector housing.

* * * * *